US010413956B2

(12) United States Patent
Shinmiya et al.

(10) Patent No.: US 10,413,956 B2
(45) Date of Patent: Sep. 17, 2019

(54) PRESS FORMING METHOD AND METHOD OF MANUFACTURING PRESS FORMED PRODUCT

(71) Applicant: JFE STEEL CORPORATION, Tokyo (JP)

(72) Inventors: Toyohisa Shinmiya, Tokyo (JP); Yuji Yamasaki, Tokyo (JP); Eiji Iizuka, Tokyo (JP)

(73) Assignee: JFE Corporation, Tokyo (JP)

( * ) Notice: Subject to any disclaimer, the term of this patent is extended or adjusted under 35 U.S.C. 154(b) by 131 days.

(21) Appl. No.: 15/115,470

(22) PCT Filed: Jan. 23, 2015

(86) PCT No.: PCT/JP2015/000301
§ 371 (c)(1),
(2) Date: Jul. 29, 2016

(87) PCT Pub. No.: WO2015/115076
PCT Pub. Date: Aug. 6, 2015

(65) Prior Publication Data

US 2017/0165735 A1 Jun. 15, 2017

(30) Foreign Application Priority Data

Jan. 30, 2014 (JP) ..... 2014-016026

(51) Int. Cl.
*B21D 22/26* (2006.01)
*B21D 53/88* (2006.01)
(Continued)

(52) U.S. Cl.
CPC ..... *B21D 22/26* (2013.01); *B21D 5/01* (2013.01); *B21D 7/06* (2013.01); *B21D 11/08* (2013.01); *B21D 53/88* (2013.01)

(58) Field of Classification Search
CPC . B21D 5/01; B21D 7/06; B21D 22/26; B21D 22/225; B21D 11/08; B21D 11/085; B21D 5/04
See application file for complete search history.

(56) References Cited

U.S. PATENT DOCUMENTS 2,639,495 A * 5/1953 Voslamber ..... B21D 5/01 29/509
2005/0056073 A1 3/2005 Ohashi et al.
2013/0255349 A1 10/2013 Lee

FOREIGN PATENT DOCUMENTS

CN 1098034 A 2/1995
CN 103357719 A 10/2013
(Continued)

OTHER PUBLICATIONS

Chinese Office Action with partial English language translation for Application No. 201580006556.4, dated Apr. 12, 2017, 8 pages.
(Continued)

*Primary Examiner* — Debra M Sullivan
(74) *Attorney, Agent, or Firm* — RatnerPrestia

(57) ABSTRACT

There is provided a press forming method capable of suppressing a camber back, which occurs in a hat-shaped member while reducing a restriction on a shape of the hat-shaped member. At a time of the press forming, a blank material (4) in which a longitudinal line length is at least longer than a longitudinal line length of a top plate portion of a hat-shaped member (5) is fixed between a pair of press dies (lower die (2), upper die (3)), which have bent surfaces (convex surface (2*a*), concave surface (3*a*)), while being warped upward, that is, in a bending direction of the lower die (2) and the upper die (3). Subsequently, for the fixed blank material (4), a bent portion of the hat-shaped member (5) is press formed by using the convex surface (2*a*) and the concave surface (3*a*).

3 Claims, 14 Drawing Sheets

(51) Int. Cl.

| | |
|---|---|
| ***B21D 5/01*** | (2006.01) |
| ***B21D 7/06*** | (2006.01) |
| ***B21D 11/08*** | (2006.01) |

(56) References Cited

FOREIGN PATENT DOCUMENTS

| | | | |
|---|---|---|---|
| JP | 2002102928 | | 4/2002 |
| JP | 2005088044 | A | 4/2005 |
| JP | 2007222906 | | 9/2007 |
| JP | 2008018442 | | 1/2008 |
| JP | 2009248087 | | 10/2009 |
| JP | 2010120058 | A | 6/2010 |
| JP | 2010207906 | | 9/2010 |
| JP | 2011206789 | | 10/2011 |
| JP | 2013063462 | | 4/2013 |

OTHER PUBLICATIONS

International Search Report and Written Opinion for International Application No. PCT/JP2015/000301, dated Mar. 3, 2015, 5 pages.
Extended European Search Report for European Application No. 15742980.4, dated Feb. 1, 2017, 6 pages.
Korean Office Action for Korean Application No. 10-2016-7020519, dated Aug. 18, 2017, including Concise Statement of Relevance of Office Action, 7 pages.

* cited by examiner

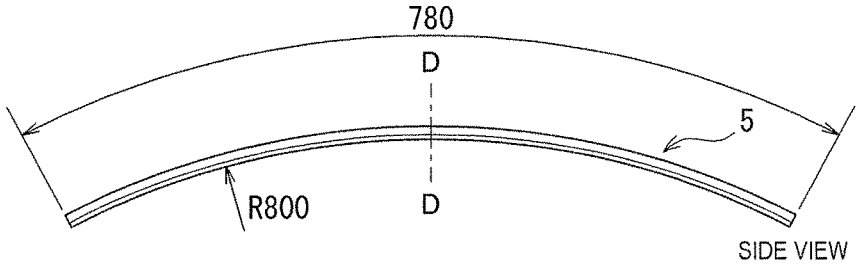
FIG. 17A
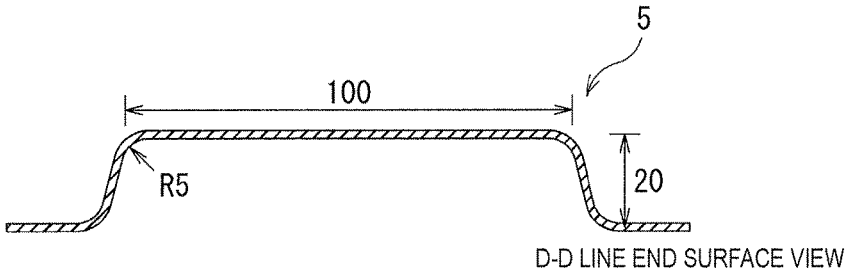
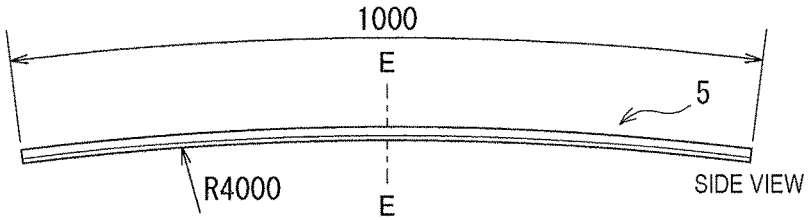
FIG. 17B
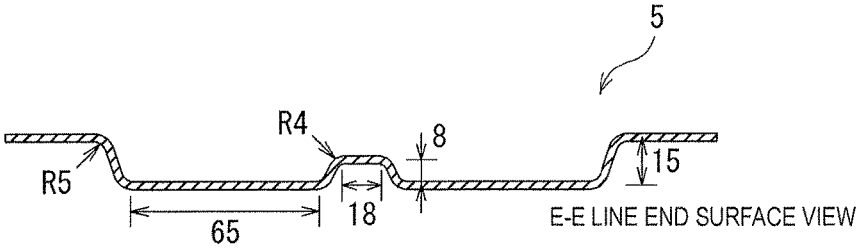

FIG. 18A

| No. | L/L0 | CAMBER BACK AMOUNT[mm] | PRESENCE OF BUCKLING | |
|---|---|---|---|---|
| 1 | 1 | 15.5 | NONE | COMPARATIVE EXAMPLE |
| 2 | 1.002 | 11.4 | NONE | INVENTION EXAMPLE |
| 3 | 1.006 | 7.3 | NONE | INVENTION EXAMPLE |
| 4 | 1.010 | 5.4 | NONE | INVENTION EXAMPLE |
| 5 | 1.018 | 3.2 | NONE | INVENTION EXAMPLE |
| 6 | 1.022 | 3.6 | PRESENT | COMPARATIVE EXAMPLE |

FIG. 18B

| No. | L/L0 | CAMBER BACK AMOUNT[mm] | PRESENCE OF BUCKLING | |
|---|---|---|---|---|
| 7 | 1 | 25.1 | NONE | COMPARATIVE EXAMPLE |
| 8 | 1.001 | 23.4 | NONE | INVENTION EXAMPLE |
| 9 | 1.003 | 19.2 | NONE | INVENTION EXAMPLE |
| 10 | 1.006 | 18.9 | NONE | INVENTION EXAMPLE |
| 11 | 1.021 | 21.5 | PRESENT | COMPARATIVE EXAMPLE |

PRESS FORMING METHOD AND METHOD OF MANUFACTURING PRESS FORMED PRODUCT

CROSS-REFERENCE TO RELATED APPLICATIONS

This is the U.S. National Phase application of PCT International Application No. PCT/JP2015/000301, filed Jan. 23, 2015, and claims priority to Japanese Patent Application No. 2014-016026, filed Jan. 30, 2014, the disclosures of each of these applications being incorporated herein by reference in their entireties for all purposes.

FIELD OF THE INVENTION

The present invention relates to a technology for manufacturing, by press forming, a formed product having a U-shaped cross section having at least a top plate portion and side wall portions continuous with both sides thereof in a width direction, and having a bent portion bent in a plate thickness direction of the top plate portion.

BACKGROUND OF THE INVENTION

In recent years, as a structural member of an automobile, a thin high-tensile steel plate or a thin aluminum alloy plate has been more often used in order to reduce weight of a vehicle body. When a formed product is released from press dies after the high-tensile steel plate or the aluminum alloy plate, which is as described above, is subjected to press forming, then a residual stress generated in the formed product is released. Thereby a springback deformation occurs, which causes a deterioration of dimensional accuracy of the formed product. Therefore, some press forming methods in which the springback deformation is hard to occur have been proposed.

Among them, methods disclosed in Patent Literatures 1 and 2 have been heretofore present as measures against a springback deformation (for example, a camber back) that occurs in a formed product (for example, a U-shaped member or a hat-shaped member) having a U-shaped cross section having at least a top plate portion and side wall portions continuous with both sides thereof in a width direction, and having a bent portion bent in a plate thickness direction of the top plate portion. Here, the camber back is a phenomenon that, in a case of forming the above-mentioned formed product having the bent portion, the formed product, which is bent, returns slightly to an original shape thereof after being released.

Patent Literature 1 discloses a method, in which a difference between a curvature radius of a top plate portion of a hat-shaped member and a curvature radius of a flange portion of the hat-shaped member is made larger than a height of the side wall portion, whereby the residual stress of the formed product owing to the press forming is reduced, and the camber back that occurs in the formed product is suppressed.

Moreover, Patent Literature 2 discloses a method, in which the bent portion of the formed product is deformed with pressure in an anti-swelling direction in the course of the press forming of the formed product, whereby the residual stress of the formed product owing to the press forming is reduced, and the camber back that occurs in the formed product is suppressed.

CITATION LIST

Patent Literature

PTL 1: JP 2013-063462 A
PTL 2: JP 2010-207906 A

SUMMARY OF THE INVENTION

However, in the technologies described in Patent Literatures 1 and 2, it is necessary to restrict a shape of the formed product though the camber back that occurs in the formed product can be suppressed, and there has been a problem of lack of versatility.

The present invention has been made focusing on the point as described above, and it is an object of the present invention to provide a press forming technology capable of reducing the camber back, which occurs in the press formed product, while reducing the restriction on the shape of the press formed product.

In order to solve the above-described problem, a press forming method according to an aspect of the present invention is a press forming method of press forming a formed product having a U-shaped cross section having at least a top plate portion and side wall portions continuous with both sides of the top plate portion in a width direction, and having a bent portion bent in a plate thickness direction of the top plate portion. The above press forming method includes at a time of press forming the formed product, fixing a blank material between a pair of press dies, which have bent surfaces for press forming the bent portion of the formed product, while warping the blank material in a bending direction of the bent surfaces of the pair of press dies, the blank material having at least a longer longitudinal line length than a longitudinal line length of the top plate portion of the formed product, and press forming the bent portion on the fixed blank material by using the bent surfaces of the pair of press dies.

Moreover, a method for manufacturing a press formed product according to an aspect of the present invention is a method of press forming a formed product having a U-shaped cross section having at least a top plate portion and side wall portions continuous with both sides of the top plate portion in a width direction, and having a bent portion bent in a plate thickness direction of the top plate portion. The above method includes fixing a blank material between a pair of press dies, which have bent surfaces for press forming the bent portion of the formed product, while warping the blank material in a bending direction of the bent surfaces of the pair of press dies, the blank material having at least a longer longitudinal line length than a longitudinal line length of the top plate portion of the formed product, and press forming the bent portion on the fixed blank material by using the bent surfaces of the pair of press dies.

In accordance with the aspect of the present invention, a gap is formed between a head portion of the press die and the blank material. Therefore, in accordance with the aspect of the present invention, during the press forming, the gap between the head portion of the press die and the blank material is crushed in an opposite direction to the bending direction of the blank material, and a compressive stress is generated in the longitudinal direction of the blank material. As a result, in accordance with the aspect of the present invention, a residual tensile stress on an outer bent side of the formed product can be reduced, and a residual bending moment of the formed product can be reduced. Therefore, in accordance with the aspect of the present invention, the occurrence of the camber back in the formed product can be suppressed. In such a way, in accordance with the aspect of the present invention, the camber back that occurs in the formed product can be reduced while reducing the restriction on the shape of the formed product.

BRIEF DESCRIPTION OF THE DRAWINGS

FIGS. 17A and 17B are views illustrating a configuration of a hat-shaped member according to examples; and FIGS. 18A and 18B are tables illustrating evaluation results of the camber back amount and presence of a buckling.

DETAILED DESCRIPTION OF EMBODIMENTS OF THE INVENTION

A description is made below of embodiments of the present invention with reference to the drawings.

First Embodiment (Camber Back)

First, prior to a description of a press forming method and a method for manufacturing a press formed product according to a first embodiment, a description is made of a camber back occurrence mechanism in general press forming.

Figure 1:
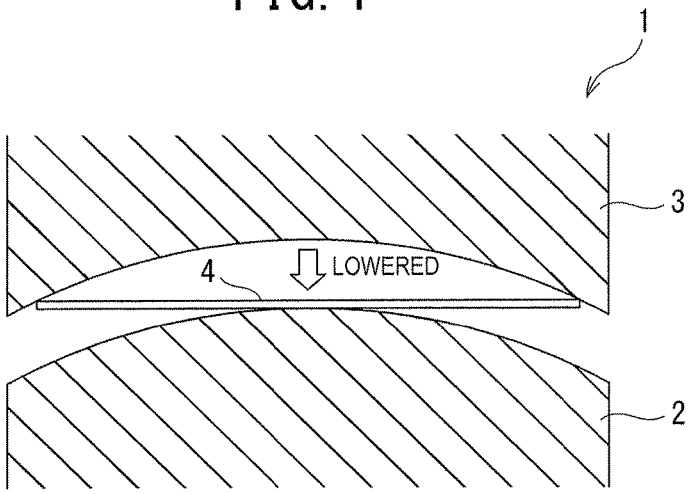
FIG. 1 is a cross-sectional view illustrating a schematic configuration of a press forming device.
Figure 2A:
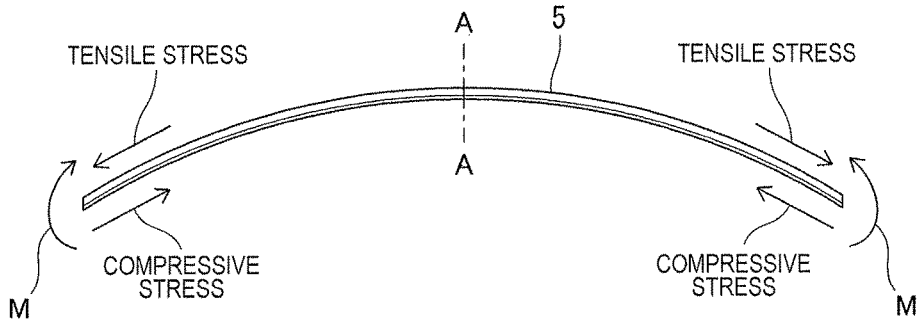
FIGS. 2A and 2B are views illustrating a configuration of a hat-shaped member.
Figure 2B:
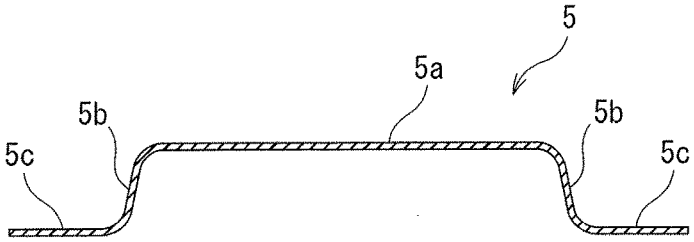
Figure 3:
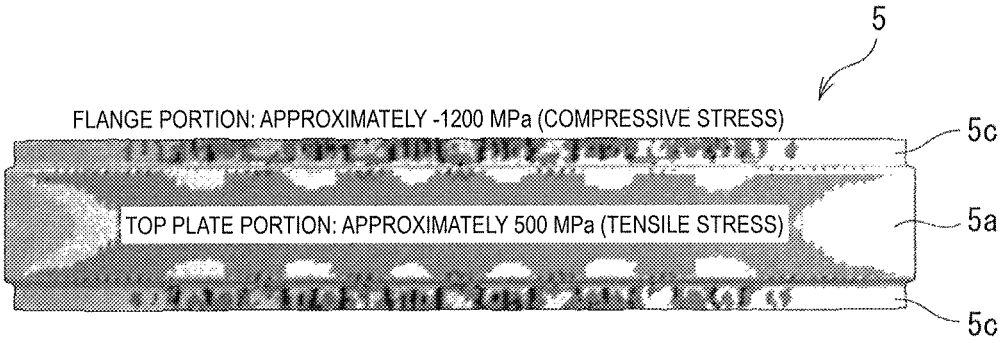
FIG. 3 is a view illustrating a distribution of a stress that acts on the hat-shaped member during press forming.

In usual, as illustrated in FIG. 1 to FIG. 3, when a blank material 4 is manufactured into a press formed product (hereinafter, also referred to as a "hat-shaped member") 5, which has a hat-shaped cross section and has a bent portion bent to be convex in a direction of a top plate portion 5*a*, by press forming by using a press forming device 1 (lower die 2, upper die 3), the top plate portion 5*a* becomes a portion on an outer bent side (convex side), and accordingly, a longitudinal tensile stress is generated in the top plate portion 5*a*. For example, the blank material 4 is a plate-like raw material cut for the press forming. Moreover, for example, the hat-shaped cross section includes one in which flange portions 5*c* are further added to a U-shaped cross section having at least the top plate portion 5*a* and side wall portions 5*b* continuous with both sides of the top plate portion 5*a* in a width direction (refer to FIG. 2B). That is to say, the hat-shaped cross section has a cross-sectional shape including at least the U-shaped cross section. Moreover, the flange portions 5*c* become portions on an inner bent side, and accordingly, a longitudinal compressive stress is generated in the flange portions 5*c*.

Here, FIG. 2A illustrates the hat-shaped member 5 viewed from the side wall portion 5*b* side, and FIG. 2B illustrates an end surface viewed by cutting the hat-shaped member 5 on a cross section taken along a line A-A of FIG. 2A. Moreover, FIG. 3 illustrates an FEM (Finite Element Method) analysis result of the hat-shaped member 5 viewed from the top plate portion 5*a* side. In the example of FIG. 3, approximately 500 MPa (tensile stress) is applied to the top plate portion 5*a*, and approximately −1200 MPa (compressive stress) is applied to the flange portions 5*c*.

Therefore, when the hat-shaped member 5 is released from the lower die 2 and the upper die 3 after the press forming, a bending moment M is generated due to the tensile stress and the compressive stress, and the camber back is generated in the hat-shaped member 5. In general, the camber back refers to a phenomenon that a material, which is bent, returns to an original shape thereof.

Note that the tensile stress and compressive stress of the hat-shaped member 5 are increased as strength (yield stress) of the blank material 4 is higher. Therefore, the camber back is increased as strength of the blank material 4 is higher.

The inventor of the present invention thinks that this camber back can be suppressed by reducing the tensile stress generated in the top plate portion 5*a* and reducing the bending moment M, and for this suppression, thinks of a press forming method and a method for manufacturing a press formed product, each of which applies a compressive stress, which is reverse to the tensile stress, to the top plate portion 5*a*.

(Press Forming Device)

Next, a description is made of a configuration of the press forming device 1 for use in the first embodiment.

Figure 4:
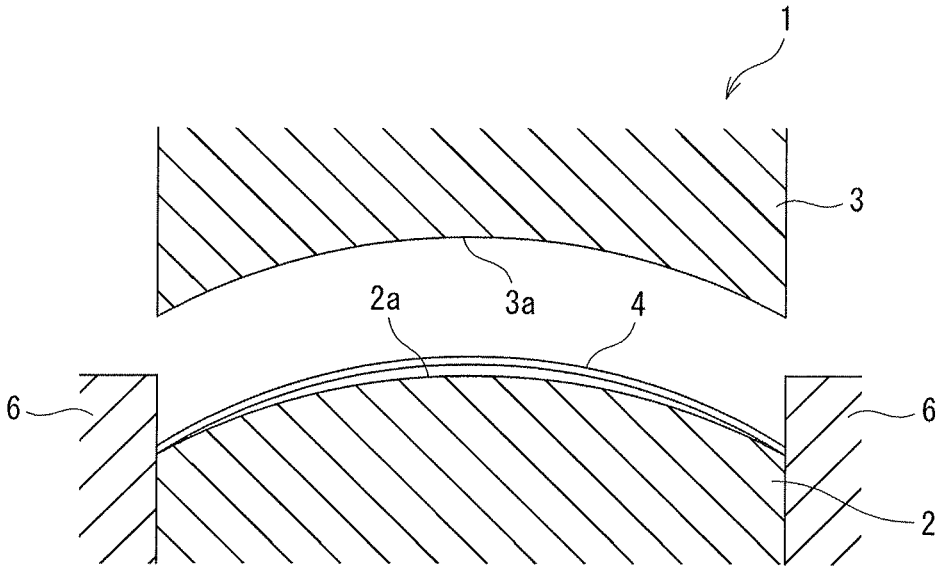
FIG. 4 is a cross-sectional view illustrating a schematic configuration of a press forming device according to a first embodiment.

As illustrated in FIG. 4, the press forming device 1 of this embodiment includes the lower die and the upper die 3 disposed oppositely to the lower die 2. On an upper surface of the lower die 2, a bent surface (hereinafter, also referred to as a "convex surface") 2*a* for press forming the bent portion bent upward. Moreover, to the convex surface 2*a*, there is further imparted a shape for press forming the hat-shaped cross section, in which the top plate portion 5*a* is formed in an upper portion (in a bending direction), and an opening portion is formed in a lower portion therein. Moreover, on a lower surface of the upper die 3, there is formed a bent surface 3*a* (hereinafter, also referred to as a "concave surface 3*a*") corresponding to a shape of the convex surface 2*a*. Then, the upper die 3 approaches the lower die 2 by lifting means (not illustrated), presses the blank material 4, which is interposed between the lower die 2 and the upper die 3, and is thereby capable of press forming the press formed product. In such a way, the hat-shaped member 5, which has the hat-shaped cross section and has the bent portion bent in the plate thickness direction of the top plate portion 5*a*, is press formed (formed).

The press forming device 1 of this embodiment further includes a pair of wall portions 6, which are opposed to individual outer peripheries on both longitudinal ends of the lower die 2. The pair of wall portions 6 are provided apart from each other by a distance equal to a distance between both longitudinal ends of the hat-shaped member 5 which is already formed. Then, before performing the press forming for the blank material 4 by pressing the same by the upper die 3 and the lower die 2, both longitudinal ends of the blank material 4 are individually allowed to abut against the pair of wall portions 6, whereby the pair of wall portions 6 are made capable of fixing (restraining) both longitudinal ends of the blank material 4, that is, capable of suppressing a longitudinal displacement of the blank material 4.

(Press Forming Method)

Next, a description is made of a press forming method and a method for manufacturing a press formed product according to the first embodiment.

Figure 5A:
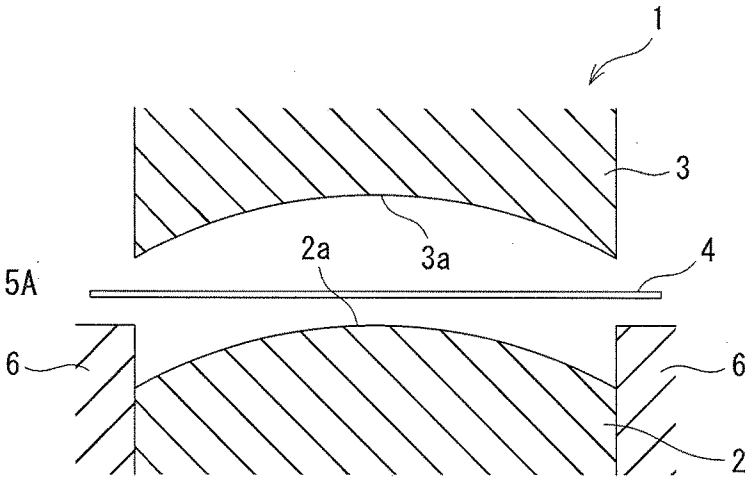
FIGS. 5A to 5D are explanatory views for explaining a press forming method according to the first embodiment.
Figure 6:
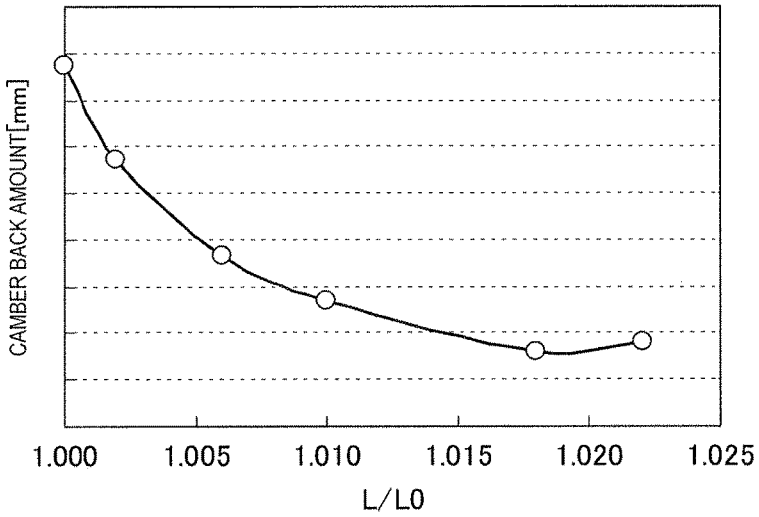
FIG. 6 is a graph illustrating a relationship between a ratio L/Lo of a longitudinal length L of a blank material to a longitudinal length Lo of the hat-shaped member and a camber back amount.

First, as illustrated in FIG. 5A, the blank material 4 is interposed between the lower die 2 and the upper die 3. As the blank material 4, one is adopted, in which at least a longitudinal length (line length) is longer than a longitudinal length (line length) of the top plate portion 5*a* of the hat-shaped member 5, that is, in which the longitudinal length (line length) is longer than a longitudinal length (line length) of the convex surface 2*a* and the concave surface 3*a*. Here, as illustrated in FIG. 6, in a range where a ratio L/Lo of the longitudinal length (line length) L of the blank material 4 to the longitudinal length (line length) Lo of the hat-shaped member 5 is 1.020 (102%) or less, a camber back amount of the hat-shaped member 5 is reduced as the ratio L/Lo is increased. However, when the ratio L/Lo is increased more than 1.020 (102%), a buckling is generated in a vicinity of each of longitudinal end portions of the blank material 4, and an effect of reducing the camber back disappears. Therefore, the longitudinal length (line length) L of the blank material 4 is set so as to satisfy $Lo<L\leq 1.020\times Lo$. That is to say, preferably, a difference between the longitudinal length (line length) L of the blank material 4 and the longitudinal length (line length) Lo of the hat-shaped member 5 is set to 2% or less.

Figure 5B:
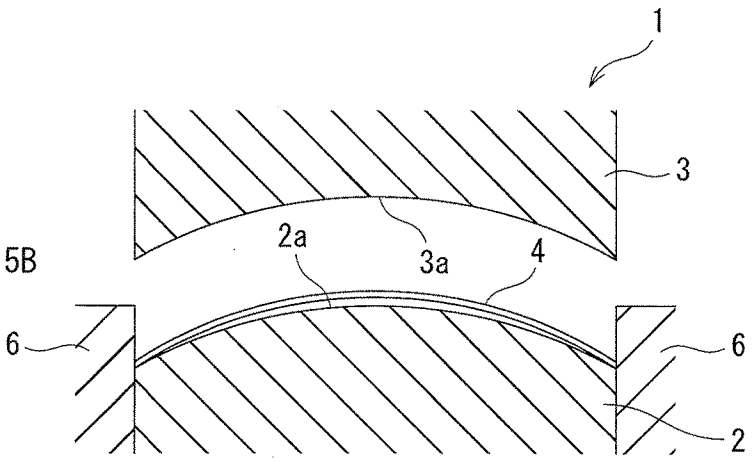

Subsequently, as illustrated in FIG. 5B, the interposed blank material 4 is warped upward, that is, in the bending direction of the lower die 2 and the upper die 3, both longitudinal ends of the blank material 4 are individually allowed to abut against the pair of individual wall portions 6, and individual lower surfaces of both longitudinal ends of the blank material 4 are brought into contact with the upper surface of the lower die 2. In such a way, both longitudinal ends of the blank material 4 are spaced apart from each other by the distance equal to that between both longitudinal ends of the hat-shaped member 5, and in addition, both longitudinal ends of the blank material 4 are fixed (restrained). At this time, a gap is formed between a head portion of the convex surface 2*a* of the lower die 2 and the blank material 4.

Note that, as such a configuration capable of positionally adjusting the pair of wall portions 6 in an opposite direction, a configuration may be adopted so that, after being once retreated right and left, the pair of wall portions 6 are allowed to approach each other one more time and to be set to a state of FIG. 5B. In this case, it is made possible to finely adjust the distance between the pair of wall portions 6 in matching with the line length of the blank material 4.

Figure 5C:
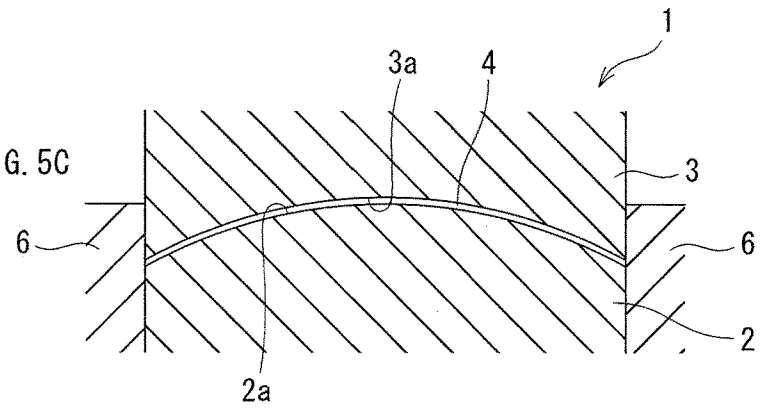

Subsequently, as illustrated in FIG. 5C, the upper die 3 is lowered by the lifting means, and the bent portion is press formed on the fixed blank material 4 by using the convex surface 2*a* of the lower die 2 and the concave surface 3*a* of the upper die 3. In such a way, the blank material 4 is subjected to the press forming (forming) into the hat-shaped member 5, which has the hat-shaped cross section and has the bent portion bent upward (in the plate thickness direction of the top plate portion 5*a* in the hat-shaped cross section).

Figure 5D:
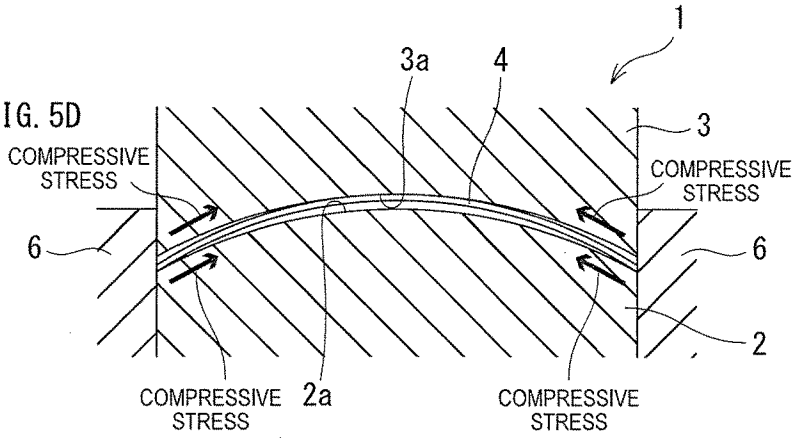
Figure 7:
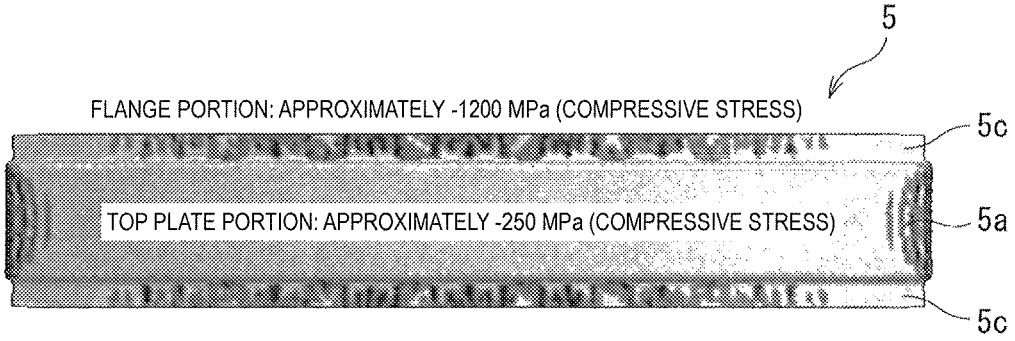
FIG. 7 is a view illustrating a distribution of a stress that acts on a hat-shaped member during press forming.

During the press forming, as illustrated in FIG. 5D, the gap between the head portion of the convex surface 2*a* of the lower die 2 and the blank material 4 is crushed downward, that is, in an opposite direction to the bending direction of the blank material 4. Then, when the above-described gap is crushed, then as illustrated in FIG. 7, a longitudinal compressive stress is generated in the blank material 4. FIG. 7 illustrates an FEM analysis result of the hat-shaped member 5 viewed from the top plate portion 5*a* side. In the example of FIG. 7, approximately −250 MPa (compressive stress) is applied to the top plate portion 5*a*, and approximately −1200 MPa (compressive stress) is applied to the flange portions 5*c*.

Figure 8:
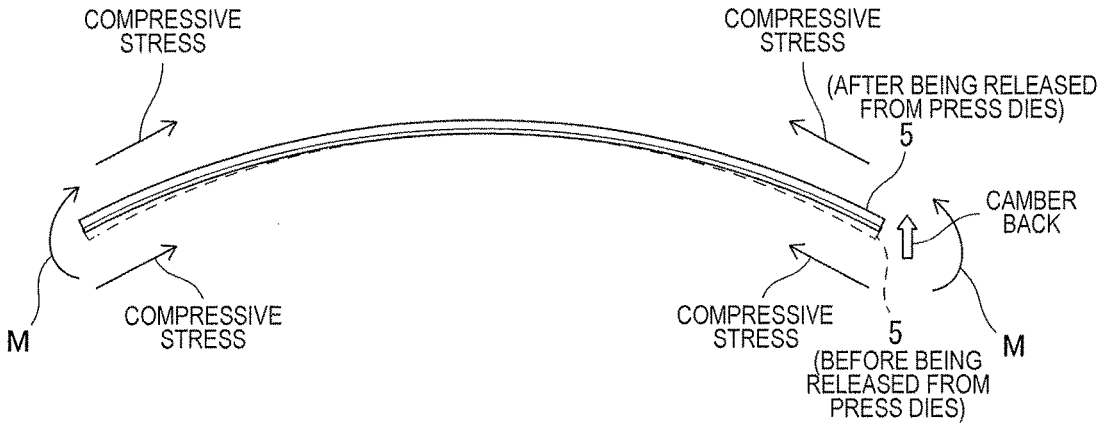
FIG. 8 is a view illustrating the camber back that occurs in the hat-shaped member.

Therefore, when the hat-shaped member 5 is released from the lower die 2 and the upper die 3 after the press forming, the bending moment M generated in the hat-shaped member 5 can be reduced. In such a way, as illustrated in FIG. 8, such a generation amount of the camber back in the hat-shaped member 5 can be suppressed. Here, in this press forming method, the shape of the hat-shaped member 5 is not limited.

In the first embodiment, the lower die 2 and the upper die 3 in FIG. 4 and FIGS. 5A to 5C compose a press die. In general, the press die refers to a "press metal die".

(Effects of First Embodiment)

The press forming method according to the first embodiment exerts the following effects.

(1) In accordance with the press forming method according to the first embodiment, at the time of the press forming, the blank material 4 in which the longitudinal line length is at least longer than the longitudinal line length of the top plate portion 5*a* of the hat-shaped member 5 is fixed between the pair of press dies (lower die 2, upper die 3), which have the bent surfaces (convex surface 2*a*, concave surface 3*a*), while being warped upward, that is, in the bending direction of the lower die 2 and the upper die 3. Subsequently, for the fixed blank material 4, the bent portion of the hat-shaped member 5 is press formed by using the convex surface 2*a* and the concave surface 3*a*.

In accordance with the configuration as described above, the gap is formed between the head portion of the convex surface 2*a* of the lower die 2 and the blank material 4. Therefore, during the press forming, the gap between the head portion of the convex surface 2*a* of the lower die 2 and the blank material 4 is crushed in the opposite direction to the bending direction of the blank material 4, and the compressive stress is generated in the longitudinal direction of the blank material 4. Accordingly, a residual tensile stress in the longitudinal direction on the outer bent side of the hat-shaped member 5 is reduced, and therefore, the residual bending moment generated in the hat-shaped member 5 can be reduced. Therefore, the occurrence of the camber back in the hat-shaped member 5 can be suppressed. In such a way, the camber back that occurs in the hat-shaped member 5 can be reduced while reducing the restriction on the shape of the hat-shaped member 5.

(2) In accordance with the press forming method according to the first embodiment, in the event of interposing the blank material 4 between the lower die 2 and the upper die 3 while warping the blank material 4 in the bending direction of the bent surfaces (convex surface 2*a*, concave surface 3*a*) of the lower die 2 and the upper die 3, both longitudinal ends of the blank material 4 are fixed while being spaced apart from each other by the distance equal to that between both longitudinal ends of the hat-shaped member 5.

In accordance with the configuration as described above, both longitudinal ends of the hat-shaped member 5 obtained by the press forming can be spaced apart from each other by a more appropriate distance, and accordingly, the hat-shaped member 5 can be press formed more appropriately.

(3) In accordance with the press forming method according to the first embodiment, in the case where L is the longitudinal line length of the blank material 4, and Lo is the longitudinal line length of the hat-shaped member 5, then L and Lo are set so as to satisfy the condition of $Lo<L\leq1.02\times Lo$.

In accordance with the configuration as described above, the longitudinal line length of the blank material 4 can be restricted. Therefore, the reduction of the buckling load of the blank material 4 can be suppressed, and during the press forming, the buckling of the blank material 4 owing to the compressive stress generated in the longitudinal direction of the blank material 4 can be prevented.

Second Embodiment

Next, a description is made of a second embodiment according to the present invention. Note that the same reference numerals are used for similar constituents and the like to those of the above-described first embodiment, and details thereof are omitted.

In a press forming method according to the second embodiment, following steps are executed. That is a first forming step of press forming the hat-shaped cross section on the blank material 4, and a second forming step of press forming the bent portion on the blank material 4 on which the hat-shaped cross section is press formed in the first step. Here, in the first forming step, a first press forming device 7 is used. Moreover, in the second forming step, a second press forming device 8 is used.

(Press Forming Device)

Figure 9:
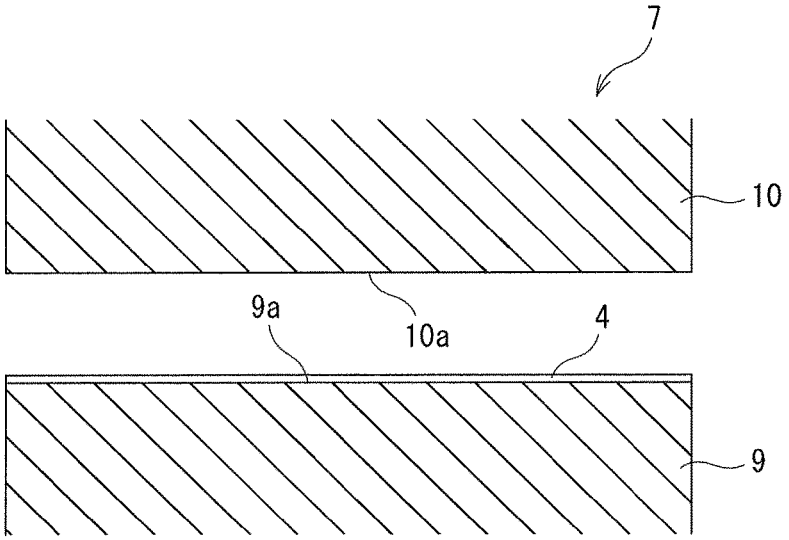
FIG. 9 is a cross-sectional view illustrating a schematic configuration of a second press forming device according to a second embodiment.

As illustrated in FIG. 9, the first press forming device 7 includes a lower die and an upper die 10 provided above the lower die 9 so as to be capable of ascending/descending. On an upper surface of the lower die 9, there is formed a shape (hereinafter, also referred to as a "convex surface") 9*a* for press forming the hat-shaped cross section, in which the top plate portion 5*a* is formed in an upper portion, and an opening portion is formed in a lower portion, on the blank material 4. Moreover, on a lower surface of the upper die 10, there is formed a shape (hereinafter, also referred to as a "concave surface") 10*a* corresponding to the shape of the convex surface 9*a*. Then, the upper die 10 is lowered by the lifting means (not illustrated), and presses the blank material 4 interposed between the lower die 9 and the upper die 10. In such a way, the hat-shaped cross section is press formed (formed).

Figure 10:
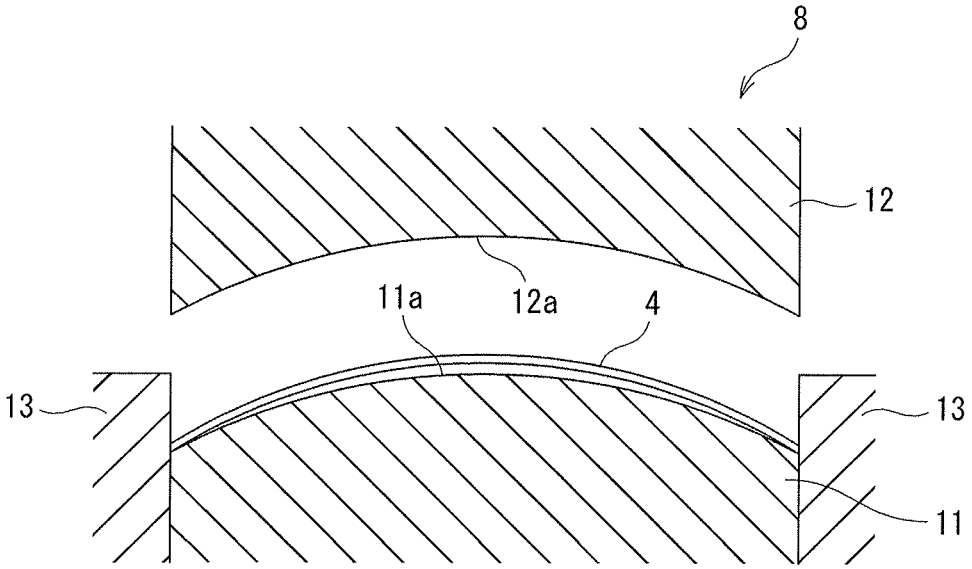
FIG. 10 is a cross-sectional view illustrating a schematic configuration of a first press forming device according to the second embodiment.

As illustrated in FIG. 10, the second press forming device 8 includes a lower die 11 and an upper die 12 provided above the lower die 11 so as to be capable of ascending/descending. Between the lower die 11 and the upper die 12, the blank material 4 on which the hat-shaped cross section is press formed is interposed while directing the top plate portion 5*a* upward and directing the opening portion downward.

On an upper surface of the lower die 11, there is formed a bent surface (hereinafter, also referred to as a "convex surface") 11*a* for press forming a bent portion formed by bending the blank material 4, on which the hat-shaped cross section is formed by the first press forming device 7, upward (in the direction of the top plate portion 5*a* in the hat-shaped cross section). Moreover, on a lower surface of the upper die 12, there is formed a bent surface (hereinafter, also referred to as a "concave surface") 12*b* corresponding to the convex surface 2*a*. Then, the upper die 12 is lowered by the lifting means (not illustrated), and presses the blank material 4 interposed between the lower die 9 and the upper die 12. In such a way, the hat-shaped member 5, which has the hat-shaped cross section and has the bent portion bent in the plate thickness direction of the top plate portion 5*a*, is press formed (formed).

The second press forming device 8 further includes a pair of wall portions 13, which are opposed to individual outer peripheries on both longitudinal ends of the lower die 11. The pair of wall portions 13 are provided apart from each other by a distance equal to the distance between both longitudinal ends of the hat-shaped member 5. Then, both longitudinal ends of the blank material 4, on which the hat-shaped cross section is formed by the first press forming device 7, individually abut against the pair of wall portions 13, whereby the pair of wall portions 13 fix (restrain) both longitudinal ends of the blank material 4, that is, suppress a longitudinal displacement of the blank material 4.

(Press Forming Method)

Next, a description is made of a press forming method and a method for manufacturing a press formed product according to the second embodiment.

Figure 11A:
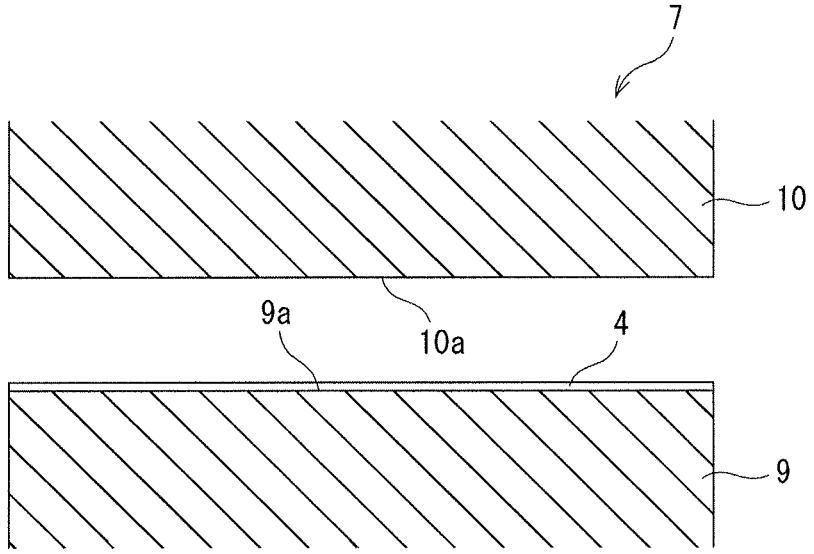
FIGS. 11A and 11B are explanatory views for explaining a press forming method according to the second embodiment.

First, there is executed a first forming step of press forming the hat-shaped cross section on the blank material 4 by using the first press forming device 7. Specifically, first, as illustrated in FIG. 11A, the blank material 4 is mounted on the upper surface of the lower die 9 of the first press forming device 7. In a similar way to the first embodiment, as the blank material 4, there is adopted at least one in which a longitudinal length (line length) is longer than the longitudinal length (line length) of the top plate portion 5*a* of the hat-shaped member 5.

Figure 11B:
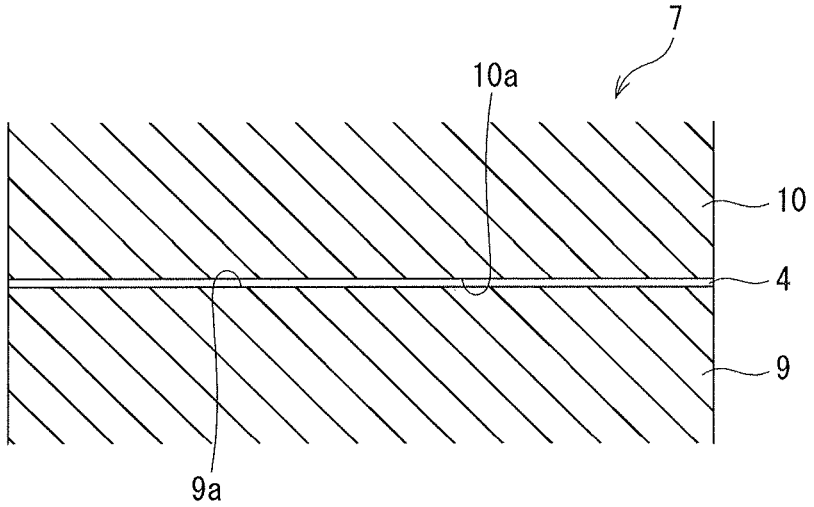

Specifically, as the blank material 4, there is adopted one that satisfies the condition of $Lo<L\leq1.02\times Lo$ in the case where L is the longitudinal length (line length) of the blank material 4, and Lo is the longitudinal length (line length) of the hat-shaped member 5. Subsequently, as illustrated in FIG. 11B, the upper die 10 is lowered to the blank material 4 by the lifting means, and the hat-shaped cross section is press formed (formed) on the mounted blank material 4 by using the convex surface 9*a* of the lower die 9 and the concave surface 10*a* of the upper die 10. At the time of this press forming, both longitudinal end portions of the blank material 4 are not fixed.

Figure 12A:
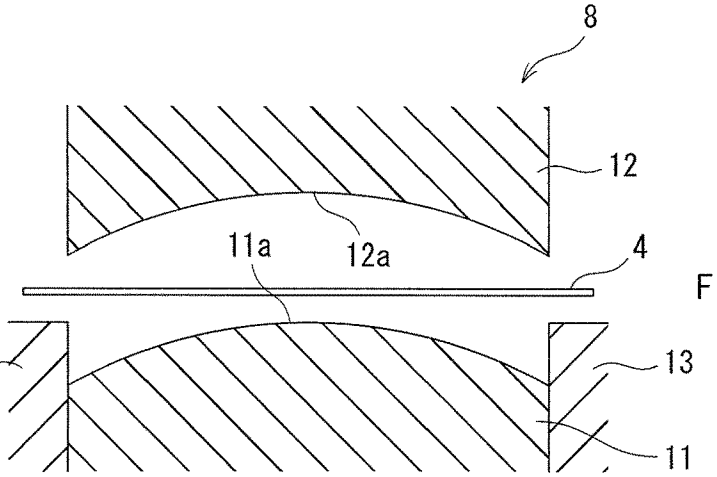
FIGS. 12A to 12D are explanatory views for explaining the press forming method according to the second embodiment.
Figure 12B:
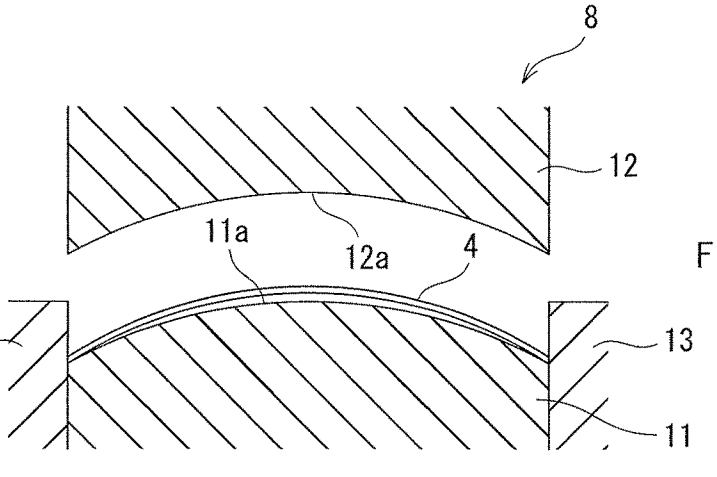

Subsequently, by using the second press forming device 8, there is executed the second forming step of press forming the bent portion on the blank material 4 on which the hat-shaped cross section is press formed in the first step. Specifically, first, as illustrated in FIG. 12A, the blank material 4 on which the hat-shaped cross section is press formed in the first step is interposed between the lower die 11 and upper die 12 of the second press forming device 8. The blank material 4 on which the hat-shaped cross section is press formed in the first step is interposed while directing the top plate portion 5*a* upward and directing the opening portion downward. Subsequently, as illustrated in FIG. 12B, the interposed blank material 4 is warped upward, that is, in the bending direction of the lower die 11 and the upper die 12, both longitudinal ends of the blank material 4 are individually allowed to abut against the pair of individual wall portions 13, and individual lower surfaces of both longitudinal ends of the blank material 4 are brought into contact with the upper surface of the lower die 11. In such a way, both longitudinal ends of the blank material 4 are spaced apart from each other by the distance equal to that between both longitudinal ends of the hat-shaped member 5, and in addition, both longitudinal ends of the blank material 4 are fixed (restrained). Moreover, a gap is formed between a head portion of the convex surface 11*a* of the lower die 11 and the blank material 4.

Figure 12C:
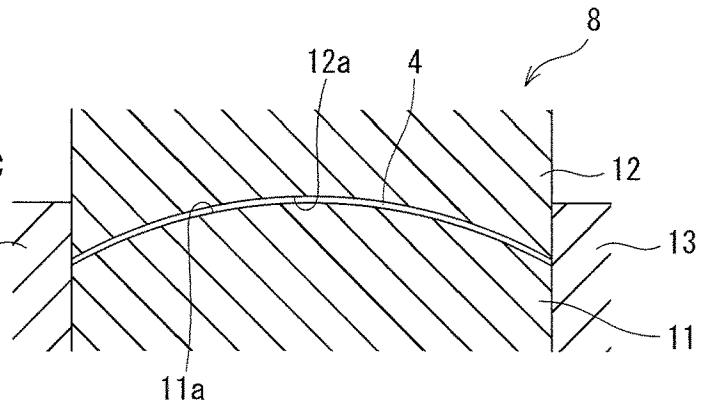

Subsequently, as illustrated in FIG. 12C, the upper die 12 is lowered by the lifting means, and the bent portion is press formed on the fixed blank material 4 by using the convex surface 11*a* of the lower die 11 and the concave surface 12*a* of the upper die 12. In such a way, the blank material 4 is subjected to the press forming into the hat-shaped member 5, which has the hat-shaped cross section and has the bent portion bent upward (in the plate thickness direction of the top plate portion 5*a* in the hat-shaped cross section).

Figure 12D:
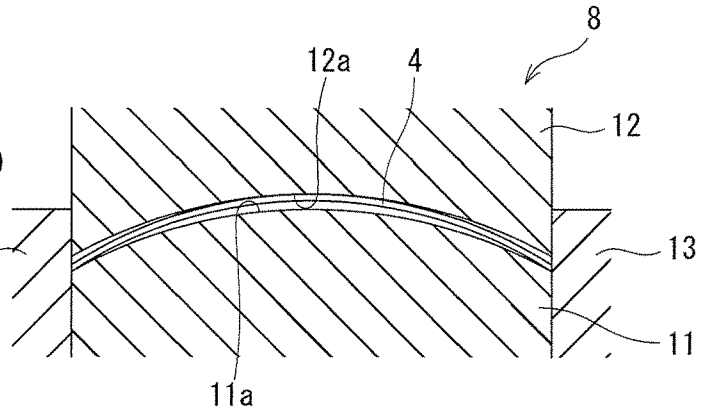

During the press forming, as illustrated in FIG. 12D, the gap between the head portion of the convex surface 11*a* of the lower die 11 and the blank material 4 is crushed downward, that is, in an opposite direction to the bending direction of the blank material 4. Then, when the gap is crushed, then a longitudinal compressive stress is generated in the blank material 4. Therefore, when the hat-shaped member 5 is released from the lower die 11 and the upper die 12 after the press forming, the bending moment M generated in the hat-shaped member 5 can be reduced. In such a way, an occurrence amount of the camber back in the hat-shaped member 5 can be suppressed.

In the second embodiment, the lower die 11 and the upper die 12 in FIG. 10 and FIGS. 12A to 12D compose a press die. In general, the press die refers to a "press metal die".

(Effects of Second Embodiment)

The press forming method according to the second embodiment exerts the following effects in addition to the effects described in the first embodiment.

(1) In accordance with the press forming method according to the second embodiment, there is executed the first forming step of press forming the hat-shaped cross section on the blank material 4 in which the longitudinal length is longer than that of the hat-shaped member 5. Subsequently, there is executed the second forming step of fixing the blank material 4, on which the hat-shaped cross section is press formed in the first forming step, between the pair of press dies (lower die 11, upper die 12) while warping the blank material 4 in the bending direction of the lower die 11 and the upper die 12, and press forming the bent portion of the hat-shaped member 5 on the fixed blank material 4 by using the bent surfaces (convex surface 2*a*, concave surface 3*a*).

In accordance with the configuration as described above, the forming of the cross-sectional shape and the bending of the blank material 4 can be realized by different press dies. Therefore, the press dies can be formed simpler in terms of shape.

Modification Example (1) Note that, in the first and second embodiments, the examples of performing the forming as the press forming are illustrated; however, other configurations may be adopted. For example, a configuration of performing draw forming using a wrinkle holder may be adopted.

(2) Moreover, in the first and second embodiments, there are illustrated the examples of forming the hat-shaped member 5, which has such a simple hat-shaped cross section as illustrated in FIGS. 2A and 2B, as the formed product; however, other configurations may be adopted. For example, as illustrated in FIGS. 13A and 13B, there may be adopted a configuration of forming a hat-shaped member 5 having a hat-shaped cross section in which a shape is given to all or apart of the top plate portion 5*a*.

Figure 13A:
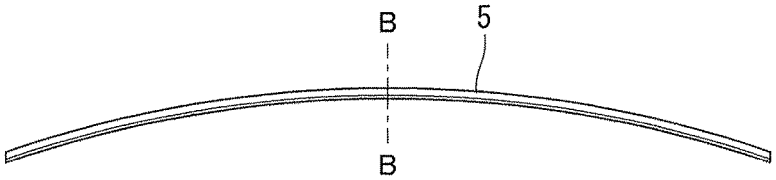
FIGS. 13A and 13B are views illustrating a configuration of a hat-shaped member according to a modification example.
Figure 13B:
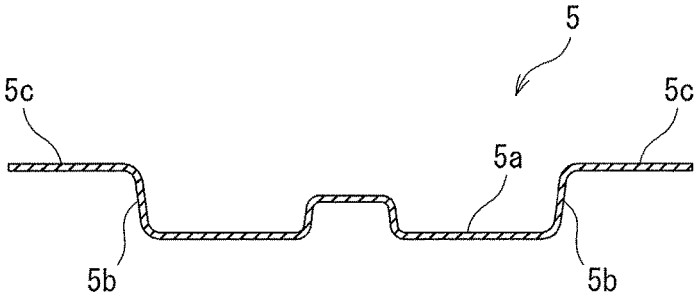

Here, FIG. 13A illustrates the hat-shaped member 5 viewed from the side wall portion 5*b* side, and FIG. 13B illustrates an end surface viewed by cutting the hat-shaped member 5 on a cross section taken along a line B-B of FIG. 13A. Moreover, there may be adopted a configuration of forming a hat-shaped member 5 having a hat-shaped cross section in which a shape is given to all or a part of the flange portions 5*c*, and there may be adopted a configuration of forming a hat-shaped member 5 in which a cross-sectional shape is changed in the longitudinal direction.

(3) Moreover, there is illustrated the example of forming, as the formed product, the hat-shaped member 5 bent in the height direction of the side wall portion 5*b* in the hat-shaped cross section, that is, the hat-shaped member 5 bent when viewed from the side wall portion 5*b* side; however, other configurations may be adopted. For example, there may be adopted a configuration of forming a hat-shaped member 5 bent when viewed from the top plate portion 5*a* side in addition to being bent when viewed from the side wall portion 5*b* side.

(4) Moreover, there is illustrated the example of forming, as the formed product, the hat-shaped member 5 in which the top plate portion 5*a* in the hat-shaped cross section is bent as the outer bent side; however, other configurations may be adopted. For example, there may be adopted a configuration of forming a hat-shaped member 5 in which the flange portions 5*c* in the hat-shaped cross section are bent as such outer bent sides.

(5) Moreover, in each of the first and second embodiments, there is illustrated the example of press forming, as the formed product, the hat-shaped member 5 having the hat-shaped cross section having at least the top plate portion 5*a* and the side wall portions 5*b* and the flange portions 5*c*, which are continuous with both sides thereof in the width direction, and having the bent portion bent in the plate thickness direction of the top plate portion 5*a*; however, other configurations may be adopted. For example, as illustrated in FIGS. 14A and 14B, there may be adopted a configuration of forming a U-shaped member 5 having the U-shaped cross section having at least the top plate portion 5*a* and the side wall portions 5*b* continuous with both sides thereof in the width direction, and having the bent portion bent in the plate thickness direction of the top plate portion 5*a*.

Figure 14A:
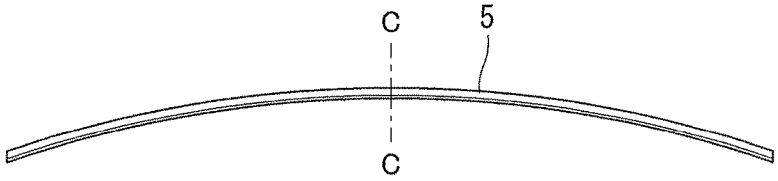
FIGS. 14A and 14B are views illustrating a configuration of a U-shaped member according to a modification example.
Figure 14B:
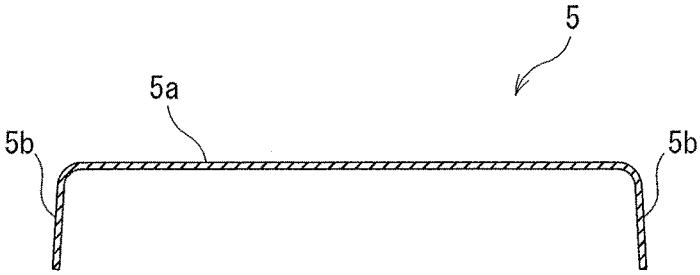

Here, FIG. 14A illustrates the U-shaped member 5 viewed from the side wall portion 5*b* side, and FIG. 14B illustrates an end surface viewed by cutting the U-shaped member 5 on a cross section taken along a line C-C of FIG. 14A.

(6) Moreover, in each of the first and second embodiments, there is illustrated the example of press forming, as the formed product, the hat-shaped member 5 having the hat-shaped cross section having at least the top plate portion 5*a* and the side wall portions 5*b* and the flange portions 5*c*, which are continuous with both sides thereof in the width direction, and having the bent portion bent in the plate thickness direction of the top plate portion 5*a*, the hat-shaped member 5 being provided entirely in the longitudinal direction; however, other configurations can also be adopted.

Figure 15:
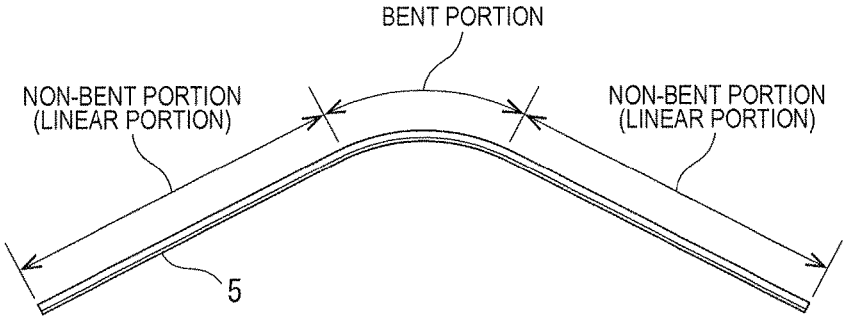
FIG. 15 is a view illustrating a configuration of a hat-shaped member according to a modification example.
Figure 16A:
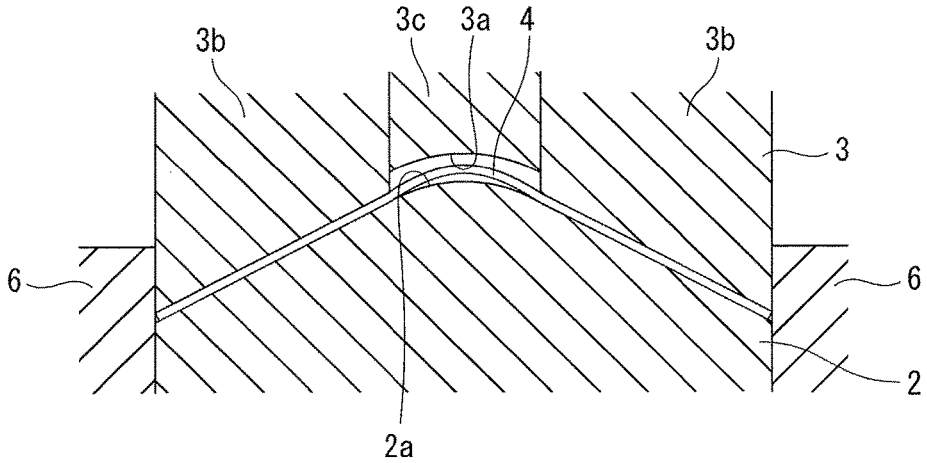
FIGS. 16A and 16B are explanatory views for explaining a press forming method according to the modification example.
Figure 16B:
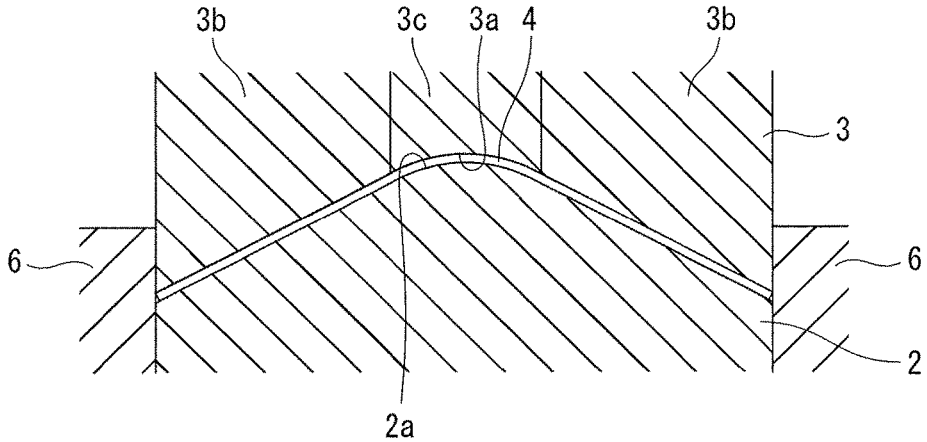

For example, as illustrated in FIG. 15, there may be adopted a configuration of press forming, as the formed product, a hat-shaped member 5 further having non-bent portions (for example, linear portions), which are not bent in the plate thickness direction of the top plate portion 5*a*, the hat-shaped member 5 being provided partially in the longitudinal direction. In this case, the upper die 3 is divided into portions (hereinafter, also referred to as "non-bent-portion dies") 3*b* for press forming the non-bent portions of the hat-shaped member 5, and a portion (hereinafter, also referred to as a "bent-portion die") 3*c* for press forming the bent portion. Then, at the time of the press forming the formed product, the press forming of the non-bent portions is first performed by using the non-bent-portion dies 3*b* as illustrated in FIG. 16A, and thereafter, the press forming of the curved portion is performed by using the bent-portion die 3*c* as illustrated in FIG. 16B. In accordance with such a configuration, at the time of the press forming the bent portion after press forming the non-bent portions, the blank material 4 on which the non-bent portions are press formed can be fixed while being warped in the bending direction of the bent surfaces of the lower die 2 and the bent-portion die 3*c*, and the bent portion can be press formed on the fixed blank material 4 by using the lower die 2 and the bent-portion die 3*c*. Therefore, the camber back that occurs at the time of press forming the bent portion can be reduced effectively while making it possible to press forming the non-bent portions partially in the longitudinal direction.

Example

A description is made below of an example of the press forming method according to the first embodiment.

In this example, the press forming method according to the first embodiment was used, and the camber back amount of the hat-shaped member 5 and presence of the buckling thereof in a case of press forming a hat-shaped member 5 having a simple hat-shaped cross section illustrated in FIG. 17A were evaluated. The FEM analysis was used for the evaluation of the camber back amount and the presence of the buckling. In the FEM analysis, LS-DYNA version 971 was used as a solver, and an arithmetic operation was performed by using a dynamic explicit method. A mesh size was set to 2 mm, and a friction coefficient was set to 0.12. As a material, an 1180 MPa-class cold-rolled steel sheet with a thickness of 1.2 mm was used. Moreover, a true stress-true strain relationship approximated by the Expression of Swift based on a true stress-true strain curve obtained from JIS No. 5 Tensile Test was used.

As illustrated in FIG. 18A, in a press forming method ("No. 1" "Comparative example" in FIG. 18A) in Comparative example, the camber back amount reached 15.5 [mm]. As the press forming method in Comparative example, a press forming method using a blank material 4 in which a longitudinal length (line length) is equal to that of the hat-shaped member 5 was adopted. In contrast, in press forming methods ("No. 2" "No. 3" "No. 4" "No. 5" "Invention example" in FIG. 18A) according to the first embodiment, that is, in the press forming methods, each of which uses the blank material 4 in which the longitudinal length (line length) is larger than that of the hat-shaped member 5, the camber back amounts thereof ranged from 11.4 [mm] to 3.6 [mm]. In such a way, in the press forming method according to the first embodiment, it was able to be confirmed that the camber back amount that occurs in the hat-shaped member 5 can be reduced in comparison with the press forming method of Comparative example.

Moreover, as illustrated in No. 6 in FIG. 18A, in the press forming method according to the first embodiment, it was able to be confirmed that the buckling occurs on both longitudinal ends of the hat-shaped member 5 when the ratio L/Lo of the longitudinal length (line length) L of the blank material 4 to the longitudinal length (line length) Lo of the hat-shaped member 5 becomes larger than 1.020.

In a similar way, the press forming method according to the first embodiment was used, and the camber back amount of the hat-shaped member 5 and the presence of the buckling thereof in a case of press forming the hat-shaped member 5 having such a hat-shaped cross section in which a top plate portion 5*a* illustrated in FIG. 17 is partially given a shape, were evaluated. In this case, as illustrated in No. 8 to No. 11 in FIG. 18B, with regard to the camber back amount and the presence of the buckling, a similar tendency to that of the hat-shaped member 5 in FIG. 17A was able to be confirmed also for the hat-shaped member 5 in FIG. 17B.

The entire contents of Japanese Patent Application No. 2014-16026 (filed on Jan. 30, 2014), of which this application claims priority, form a part of the present disclosure by reference.

Here, the description is made while referring to the limited number of embodiments; however, the scope of rights is not limited to these, and for those skilled in the art, modifications of the respective embodiments, which are based on the above-described disclosure, are obvious.

REFERENCE SIGNS LIST

1 press forming device
2 lower die (press die)
3 upper die (press die)
4 blank material
5 hat-shaped member
6 wall portion
7 press forming device
8 press forming device
11 lower die (press die)
12 upper die (press die)
13 wall portion

The invention claimed is:

1. A press forming method of press forming a formed product having a U-shaped cross section in a width direction having at least a top plate portion and side wall portions continuous with both sides of the top plate portion in a width direction, and having a bent portion bent in a plate thickness direction along a longitudinal direction of the top plate portion, the press forming method comprising:

fixing a blank material between a pair of press dies which have bent surfaces, while warping the blank material in a bending direction of the bent surfaces of the pair of press dies, the blank material having at least a longer longitudinal line length than an intended longitudinal line length of the top plate portion of the formed product; and press forming the warped fixed blank material to form the bent portion by using the bent surfaces of the pair of press dies to form the formed product having the U-shaped cross section and having the bent portion.

2. The press forming method according to claim 1, wherein the formed product further includes a non-bent portion, which is not bent in the plate thickness direction of the top plate portion, partially in a longitudinal direction, and the press-forming step further includes press-forming the non-bent portion before press-forming the bent portion.

3. The press forming method according to claim 1, wherein the blank material is fixed while spacing both longitudinal ends of the blank material apart from each other by a distance equal to an intended distance between both longitudinal ends of the formed product when interposing the blank material between the pair of press dies while warping the blank material in the bending direction of the bent surfaces of the pair of press dies.

* * * * *